US005330673A

United States Patent [19]

Bayless

[11] Patent Number: 5,330,673

[45] Date of Patent: Jul. 19, 1994

[54] AUTO BODY CLEANER AND ALL PURPOSE ADHESIVE AND URETHANE CLEANER

[75] Inventor: Ronnie E. Bayless, Plant City, Fla.

[73] Assignee: Dotolo Research Corp., Largo, Fla.

[21] Appl. No.: 105,704

[22] Filed: Aug. 12, 1993

[51] Int. Cl.[5] ..... C11D 3/18; C11D 1/83; C11D 1/66; C11D 3/20

[52] U.S. Cl. ..... 252/171; 252/153; 252/162; 252/170; 252/364; 252/549; 252/174.19; 252/544; 252/546; 252/167; 252/166

[58] Field of Search ..... 252/153, 162, 170, 171, 252/364, 549, 174.19, 544, 546, 167, 166; 134/29, 40

[56] References Cited

U.S. PATENT DOCUMENTS

| | | | |
|---|---|---|---|
| 5,031,648 | 7/1991 | Lutener et al. | 252/170 X |
| 5,213,624 | 5/1993 | Williams | 252/171 X |
| 5,277,836 | 1/1994 | Peters | 252/170 X |

FOREIGN PATENT DOCUMENTS 9202665 2/1992 PCT Int'l Appl. .

OTHER PUBLICATIONS

Kirk-Othmer, *Encyclopedia of Chemical Technology*, 3rd ed., John Wiley & Sons, 1978, vol. 2, p. 91, and vol. 8, pp. 909-919.

*Primary Examiner*—Paul Lieberman
*Assistant Examiner*—Douglas McGinty
*Attorney, Agent, or Firm*—Marshall & Melhorn

[57] ABSTRACT

An auto body cleaning composition for removing tar and urethane adhesive from auto bodies, composition consisting of (A) d-limonene and (B) about 2 to 12 percent by weight of the composition of a surfactant that is cocamide DEA/dihexyl sodium sulfosuccinate. Another auto body cleaning composition comprises d-limonene, Sorbitan Monolaurate and mineral oil.

7 Claims, No Drawings

AUTO BODY CLEANER AND ALL PURPOSE ADHESIVE AND URETHANE CLEANER

The present invention relates to Auto Body Cleaner and/or All Purpose Adhesive and Urethane Cleaner compositions comprising d-limonene and a surfactant for cleaning automobile bodies including removing urethane products therefrom and/or the further addition of mineral oil when Sorbitan Monolaurate surfactant is used, which effectively reduces the possibility of skin irritation.

BACKGROUND OF THE INVENTION

In the manufacturing and repairing of auto bodies and/or manufactured parts, it is highly desirable to clean such bodies and/or all other parts to remove therefrom unwanted materials such as urethane products, adhesives, bugs, tar, and grease. The cleaning composition should be effective, safe and relatively free from objectionable odor.

OBJECTS OF THE INVENTION

It is an object of the invention to provide an efficient, safe, easy to use, auto body cleaner composition that is composed of d-limonene and about 2.5 percent by weight to about 10 or 20 percent by weight of the composition of cocoamide/DEA/dihexyl sodium sulfosuccinate.

It is an object of the invention to provide an efficient, safe, easy to use, auto body cleaner and/or all purpose adhesive and urethane cleaner composition that is composed of d-limonene and about 1 percent by weight to about 1 to 15 percent by weight of the composition of Sorbitan Monolaurate, and 10 percent of mineral oil by weight to about 5 to 25 percent by weight, and 0.05 to 1 percent by weight for an antioxidant (BHT).

These and other objects of the invention will be apparent from the specification that follows and the appended claims.

SUMMARY OF THE INVENTION

The present invention provides an auto body cleaner and all purpose adhesive and urethane remover composition consisting essentially of (A) d-limonene and (B) about 2 to 12 percent by weight of a (nonionic and anionic) surfactant that is cocamide DEA/Dihexyl sodium sulfosuccinate (CDDSS) Monamulse DL-1273 TM. This is a preferred formula having no mineral oil or Sorbitan Monolaurate.

In another embodiment, the present invention also provides an auto body cleaner and/or all purpose adhesive and urethane remover composition containing no CDDSS, and consisting essentially of (A) d-limonene, (B) about 1 to 15 percent by weight of Sorbitan Monolaurate, (C) about 5 to 25 percent by weight of mineral oil, and (D) about 0.05 to 1 percent of BHT.

General, preferred and optimum compositions of the invention are as follows in approximate percent by weight.

| Ingredients | General | Preferred | Optimum |
|---|---|---|---|
| d-limonene | 88–98 | 90–97 | 90 |
| Surfactant: (anionic and nonionic) | 2–12 | 3–10 | 10 |

-continued

| Ingredients | General | Preferred | Optimum |
|---|---|---|---|
| (Monamulse DL-1273 TM | | | |

In the above formulation, containing CDDS, an antioxidant can be issued as follows:

| | | | |
|---|---|---|---|
| BHT | 0.5–1 | .001–.5 | 0.25 |

DETAILED DESCRIPTION OF THE INVENTION

Example

The following preferred composition was tested and found to effectively clean auto bodies and remove grease and urethane products;

| Ingredient | % by weight |
|---|---|
| d-limonene | 90 |
| Monamulse DL-1273 TM surfactant (Cocamide DEA/ Dihexyl Sodium Sulfosuccinate) | 10 |

In another embodiment, containing no CDDSS, the composition is as follows:

| Ingredients | General | Preferred | Optimum |
|---|---|---|---|
| d-Limonene | 75–98 | 87–97 | 88 |
| mineral oil | 4–25 | 5–29 | 10 |
| Sorbitan Monolaurate | 0.5–10 | 0.5–5 | 1 |
| BHT | .05–1 | .001–.5 | 0.2 |

The above non-aqueous composition containing CDDSS was applied to auto bodies covered with grease, tar, urethane and adhesive and urethane products. The bodies were cleaned by cloth wiping. There was little or no skin irritation from the composition.

A composition of a dibasic ester (90% total weight percent) and CDDSS surfactant (10%) was not satisfactory. Likewise, a composition of d-limonene and 10% ethoxylated undecyl alcohol was not satisfactory.

The cleaning composition of the Example with CDDS provides superior and highly advantageous results, there being no film left behind. The CDDSS surfactant provides superior results.

Sorbitan Monolaurate also provides superior results (when used with d-limonene and mineral oil) and is not known to be of an irritation to the skin.

A preferred d-limonene is the Glidco (SCM) Glidsafe TM Limonene 145. This d-limonene is a high quality low odor terpene solvent having the following specification and typical properties.

| SPECIFICATIONS | |
|---|---|
| Appearance | Clear |
| Color (APHA) maximum | |
| Flash Point (TCC) | 50 |
| Organoleptically | ∠110° (50.0° C.) |
| Controlled Product | Yes |

| TYPICAL PROPERTIES | |
|---|---|
| Specific Gravity, @ 26.515/5° C. | 0.849 |
| Kauri-Butanoil Value | 6.1 |
| Flash Point (TCC) | 110° F.(43.3° C.) |
| Boiling Point @ 760 mm Hg | 352°(177.8° C.) |
| Evaporation Rate (secs to 90%) | 900 |

A highly preferred d-limonene component is Glidco (SCM) Glidsafe TM Limonene DL, a synthetic, low odor d-limonene with no noticeable citrus odor.

Limonene DL has the following physical/chemical characteristics:

| PHYSICAL/CHEMICAL CHARACTERISTICS | |
|---|---|
| Boiling Range: | Initial Boiling Pt = 347° F. |
| Physical State: | Liquid |
| Color: | Clear, colorless |
| Specific Gravity: | 0.841 @ 25° C. |
| Percent Volatile at 70° F.: | 100% |
| Solubility in Water: | Insoluble |
| Evaporation Rate (Butyl Acetate 1) | <1 |

An antioxidant, BHT can be used generally in an amount of about 0.1 to 1 percent by weight of the composition and preferably about 0.2 or 0.25 percent by weight to about 0.5 or 0.8 percent by weight.

The cleaner composition has an outstanding balance of properties including easy removal of grease, tar and urethane adhesive coatings from auto body surfaces, being non-irritating to the skin, having a pleasant odor, having miscible ingredients, and leaving the cleaned surfaces free of surface film.

What is claimed is:

1. A non-aqueous cleaning composition consisting of the following ingredients in approximate percentage by weight:

| Ingredients | Percent |
|---|---|
| D-limonene | 80 to 97.5 |
| cocamide DEA/dihexyl sodium sulfosuccinate | 2.5 to 20 |

2. An auto body cleaner composition consisting of d-limonene and about 6 to 14 percent by weight of the composition of cocamide DEA/dihexyl sodium sulfosuccinate.

3. A composition as defined in claim 2 having about 8 to 12 percent by weight of cocamide DEA/dihexyl sodium sulfosuccinate.

4. A composition as defined in claim 2 having about 10% per weight of cocamide DEA/dihexyl sodium sulfosuccinate.

5. A non-aqueous cleaning composition consisting of the following ingredients in approximate percent by weight:

| Ingredients | Percent |
|---|---|
| d-Limonene | 75–98 |
| mineral oil | 4–25 |
| Sorbitan Monolaurate | 1–10 |

6. A cleaning composition as defined in claim 5 in which an antioxidant is used in an amount of about 0.05 to 1 percent by weight.

7. A non-aqueous cleaning composition consisting of (A) d-limonene and (B) about 2.5 to 20% per weight of the composition of cocoamide DEA/dihexyl sodium sulfosuccinate.

* * * * *